United States Patent [19]

Bonerb

[11] Patent Number: 4,487,335

[45] Date of Patent: Dec. 11, 1984

[54] VALVE ASSEMBLY AND CONTROL SYSTEM FOR MATERIAL HANDLING AND STORAGE BIN

[75] Inventor: Timothy C. Bonerb, Buffalo, N.Y.

[73] Assignee: Vincent C. Bonerb, Boston, N.Y.

[21] Appl. No.: 465,797

[22] Filed: Feb. 11, 1983

[51] Int. Cl.[3] ..... B65D 88/16; B65D 88/62

[52] U.S. Cl. ..... 222/57; 222/61; 222/63; 222/66; 222/386.5; 222/389; 91/32; 91/469; 137/595; 137/625.25

[58] Field of Search ..... 222/61, 64, 96, 386.5, 222/389, 95, 202, 203, 52, 53, 63, 105, 65, 66, 387, 388, 55, 57–59; 137/595, 625.25; 91/6, 32, 275, 454, 469; 141/10, 65, 67, 68, 114, 313–317

[56] References Cited

U.S. PATENT DOCUMENTS 3,128,912 4/1964 Cash ..... 222/389 X
3,209,680 10/1965 McGinnis ..... 222/386.5 X
4,273,027 6/1981 Reinhard et al. ..... 91/32
4,421,250 12/1983 Bonerb et al. ..... 222/386.5 X

FOREIGN PATENT DOCUMENTS 2398684 2/1979 France ..... 222/389
WO82/03839 11/1982 PCT Int'l Appl. ..... 222/64
1144162 3/1969 United Kingdom .

*Primary Examiner*—Joseph J. Rolla
*Assistant Examiner*—Kevin P. Shaver
*Attorney, Agent, or Firm*—Bernard, Rothwell & Brown

[57] ABSTRACT

A free-flowing granular material storage bin of the type having an inflatable dual-walled, cup-shaped bag with a fan for inflating and deflating the bag has a single valve assembly of unique construction for controlling high volume low pressure flow for inflation and deflation cycles. The cycles are themselves automatically controlled from sensing units which sense when the bag is fully emptied and fully deflated.

12 Claims, 5 Drawing Figures

VALVE ASSEMBLY AND CONTROL SYSTEM FOR MATERIAL HANDLING AND STORAGE BIN

BACKGROUND OF THE INVENTION

1. Field of the Invention

This invention relates to improvements in valves and control systems, particularly those adaptable for use in a material handling system of the type utilizing a dual walled cup-shaped inflatable bag.

2. Prior Art

In commonly owned co-pending applications, Ser. No. 257,604 filed Apr. 27, 1981, now U.S. Pat. No. 4,421,250 of Dec. 20, 1983, Ser No. 307,089 filed Sept. 30, 1982, now U.S. Pat. No. 4,449,649 of May 22, 1984, Ser. No. 357,589 filed Mar. 12, 1982, Ser. No. 357,592 filed Mar. 12, 1982, and PCT International Publication No. W082/03839 of Nov. 11, 1982, there are disclosed systems of handling, storing, and discharging free-flowing granular material utilizing a generally cup-shaped, dual walled, inflatable bag for assisting in the discharge of material after it assumes its angle of repose following gravity discharge. In connection with the development of the inventions disclosed in the co-pending applications, it was discovered that there were no suitable valve assemblies and controls needed for controlling the high volume, low pressure air flow required for inflating or deflating the bag.

British Pat. No. 1,144,162 discloses a lined silo in which the liner is expanded by pressure to assist gravity discharge. The fluid pressure control components are shown schematically as a pump, compressor, and three-way valve alternatively connecting the space between the liner and the rigid wall to the pump or compressor. This arrangement has disadvantages in that it lacks automatic controls, lacks means for sensing the end of inflation and deflation cycles, and utilizes extra and unneeded components.

There is a need in the art for a relatively high-volume, low-pressure four conduit fluid flow control valve assembly which can be switched automatically from one cycle to another, i.e., from the inflation cycle to the deflation cycle. It is highy desirable to utilize other than manual controls for changing cycles and to have the valves controlling the conduits through which the inflating and deflating air passes operate quickly and reliably to handle the large volume of low pressure air from a fan or the like.

SUMMARY OF THE INVENTION

This invention provides a unique unitary-valve assembly for controlling high-volume low-pressure air flow through two inlet and two outlet conduits utilized separately and in tandem to control inflation and deflation of a cup-shaped bag utilized in the storage and discharge of free-flowing granular material. The unitary valve assembly is composed of two pairs of slide actuated gate valves operated in tandem by a motor-driven screw, which in turn is automatically controlled. Sensors sense when the bag is fully emptied of the material being stored to cause the valves to reverse and put the system in a deflation mode. After complete deflation, further sensors sense complete deflation to turn off the unit.

BRIEF DESCRIPTION OF THE DRAWINGS

FIG. 1(*a*) is a fragmentary schematic partial elevation view of the bin when the material discharging, bag inflating cycle is completed illustrating the sensing of such condition.

DETAILED DESCRIPTION OF PREFERRED EMBODIMENTS

Figure 1:
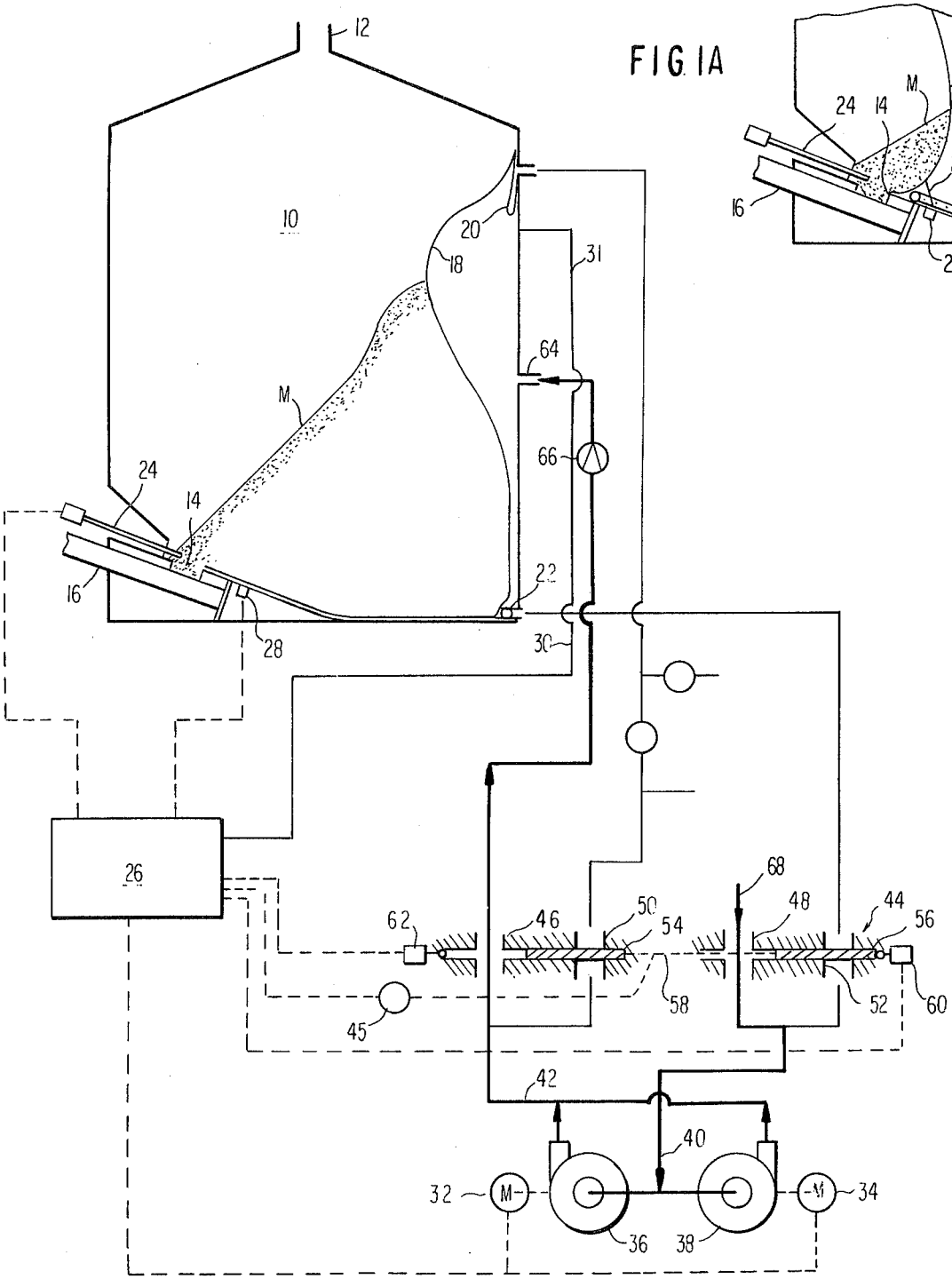
FIG. 1 is a schematic elevation view of the bin and controls including the valve assembly of this invention in a material discharging/bag inflating cycle.

Referring to FIG. 1, and to the commonly owned applications for further details not shown, a material storage bin 10 has a filling opening 12 therein. The bin includes a discharge opening 14 positioned adjacent a discharge conveyor 16. The bin contains a generally cup-shaped, double walled, inflatable bag 18 as described in greater detail in the commonly owned applications referred to above.

For creating slack only at the top edge of the bag walls during filling there is provided an inflatable collar or pillow 20, and for returning the inner wall of the bag to the periphery of the inner wall of the bin during deflation there is provided a peripherally positioned perforated tube 22 to which vacuum is applied.

As described in the aforesaid applications, a granular free-flowing material is discharged through the discharge opening 14 by the action of gravity until the material reaches its angle of repose. Thereafter, as the bag is gradually inflated, its inner wall bulges starting at the top and nudges more of the granual material over the angle of repose and into the discharge opening.

The bin is provided with a material sensor 24, which, through control box 26, controls the operation of motors 32 and 34 driving parallel low pressure fans 36 and 38. The conveyor 16 will continuously convey away material filling discharge opening 14. When there is sufficient material filling the opening the sensor 24 senses the material and through the control box 26 turns off the fans 36 and 38 so they need not run continuously. However, when the sensor 24 senses there is insufficient material to fill the discharge 14 the fans 36 and 38 are turned on to further inflate the inner wall of the bag, force the inner wall 18 inwardly and nudge more of the material over its angle of repose and into the discharge opening 14. A conveyor drive motor 17 is connected to the control box 26 so that when the conveyor 16 is turned off then the probe 24 is off and the blowers 36, 38 are off, for protection of the system.

There are two fans shown to handle a large capacity bin, both from the standpoint of inflation and deflation. However, a single fan and drive motor of appropriate size could likewise suffice. The fans are capable of developing about two pounds per square inch gauge pressure. Typically the pressure required for inflating the bag is about half of this amount. However, the inflation pressure will vary with the material being handled within the bin and the size of the bag.

Suitable conduits are connected to the fans including fan inlet conduit 40 leading to both fans 36 and 38 and fan outlet conduit 42 leading from both fans.

Figure 2:
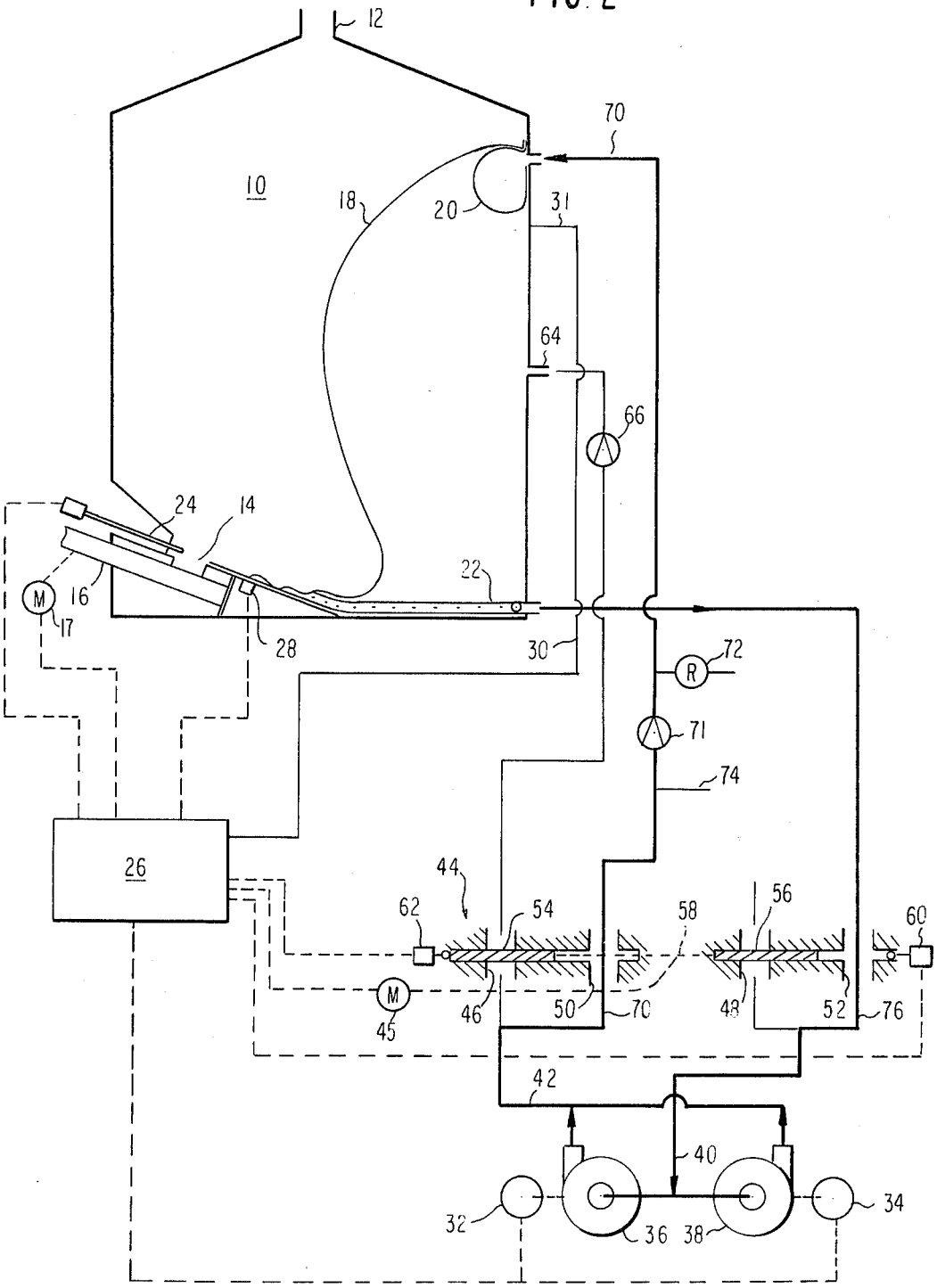
FIG. 2 is a schematic elevation view similar to FIG. 1 showing the position of the bin bag and controls in the bag deflation cycle.
Figure 3:
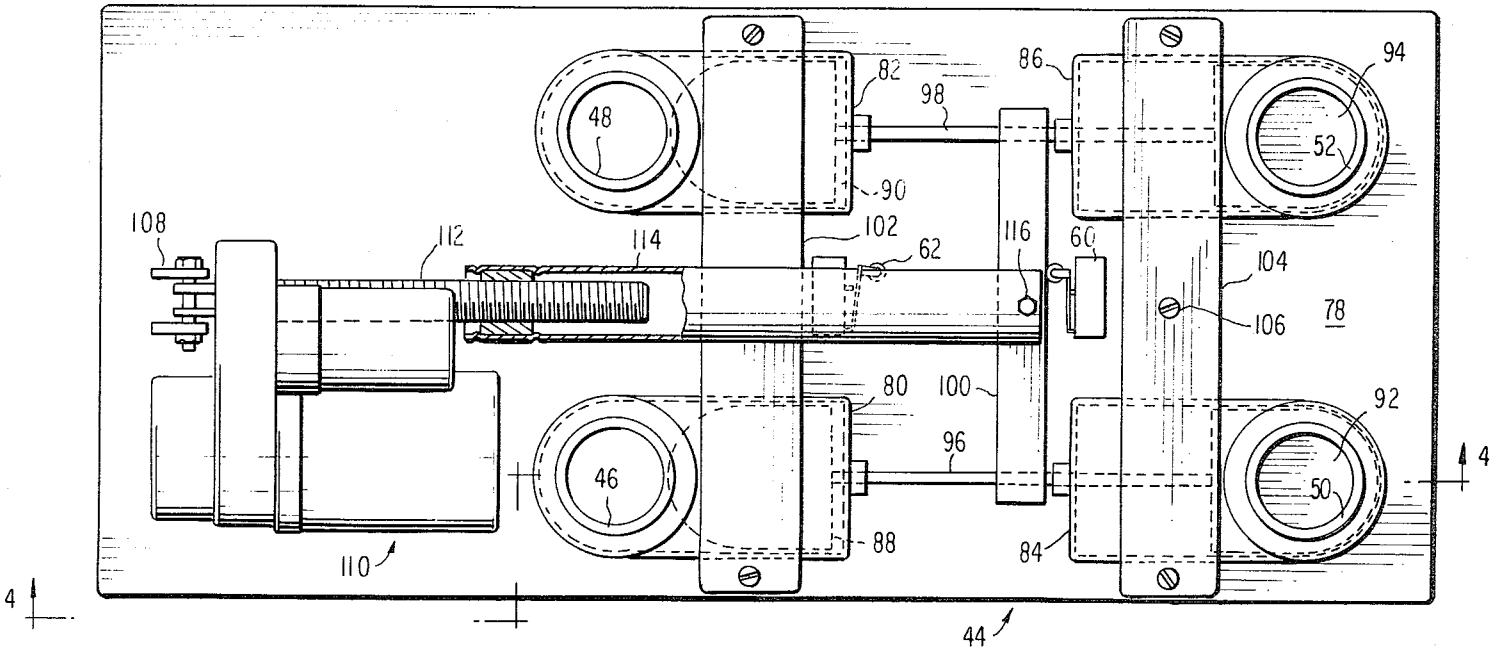
FIG. 3 is a top plan view of the control valve assembly of this invention with portions broken away for the sake of clarity.
Figure 4:
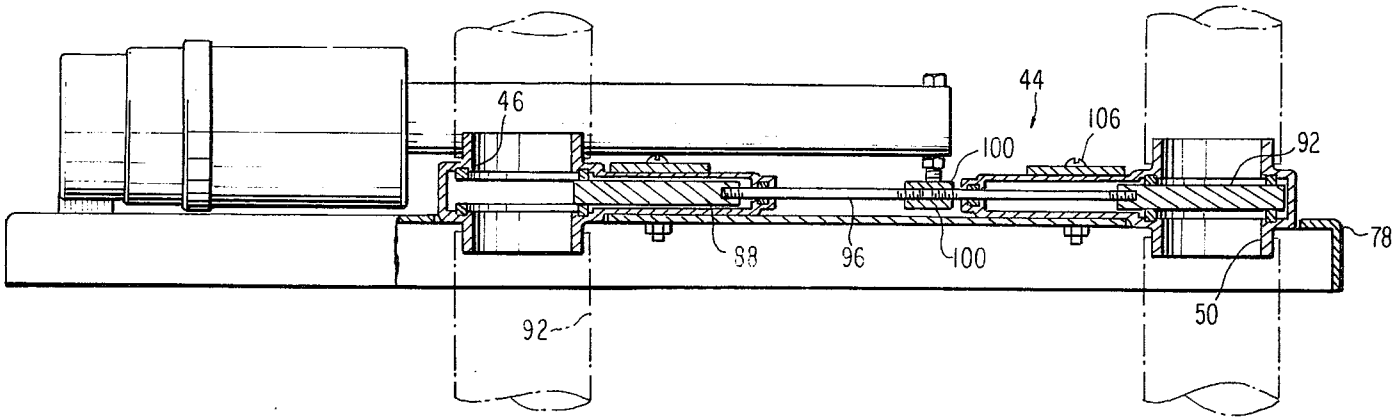
FIG. 4 is a sectional elevation view taken along 4-4 of FIG. 3.

For controlling the application of air pressure for either inflation or deflation of the bag there is provided a unique valve assembly 44, illustrated schematically in FIGS. 1 and 2 and shown in mechanical detail in FIGS. 3 and 4. The valve assembly is driven by motor means 45 from control box 26. There are four passages through the valve assembly 44, namely, valve passage 46 for inflation cycle pressure, valve passage 48 for inflation cycle suction, valve passage 50 for deflation cycle pressure, and valve passage 52 for deflation cycle suction.

Valve gates 54 and 56 are shown schematically and they alternately open or close the respective pairs of valve passages as shown in the inflation cycle in FIG. 1, and as shown in the deflation cycle in FIG. 2.

The valves contact limit switches 60 and 62 which, through control box 26, control the operation of motor 45. That is, after motor 45 puts the valve gates 54 and 56 (which are connected together through linkage 58) into position as shown in FIG. 1, limit switch 60 will stop motor 45. Similarly, when the assembly is in position in FIG. 2, limit switch 62 operates to control and stop motor 45.

Referring again to FIG. 1, during the inflation cycle in which the fans 36 and 38 are periodically operated to apply pressure, air under pressure flows through line 42 and open valve passage 46 to an inflation opening 64 in the double-walled inflatable bag. In the line leading to inflation opening 64 is a check valve 66 so as to prevent deflation of the bag when the sensor turns the fan motors off.

Air to supply the fans 36 and 38 through conduit 40 comes from an open end 68 of conduit 40 leading to the atmosphere and passes through open valve passage 48.

Figure 1A:
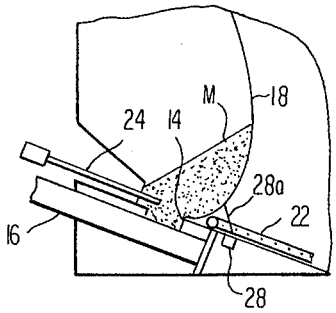

As shown in FIG. 1A, a bag empty sensor 28 in the form of a toggle switch has a cord **28*a* connected to it and to the bag wall 18. When the bag 18 is in the empty position at the end of the inflation cycle the cord 28*a* operates the sensor switch 28 as shown in FIG. 1A. At that time, sensor 28 through control box 26 causes the motor 45 to reverse, moving the valve gates 54 and 56 to the position shown in FIG. 2**. Alternatively a mercury switch which monitors the bag wall position could be used in place of the toggle switch and cord.

In FIG. 2 there is shown the position of the components during the deflation cycle. During the deflation cycle the fans 36 and 38 blow air through conduit 42 and valve passage 50. Air pressure at the end 70 of the conduit inflates the slack-creating inflatable collar 20 within the walls of the double-walled bag. Within the conduit 70 there is a check valve 71 to prevent reverse flow and deflation of the collar when the fans 36 and 38 are turned off at the end of the deflation cycle. Positioned in the line above check valve 71 is a pressure relief valve 72 so that excess pressure within inflatable collar 20 may be relieved when material in the bin compresses the collar. There is further provided a restrictive vent 74 to the atmosphere to allow pressure to be vented during the deflation cycle.

Suction is pulled on line 40 by fans 36 and 38 and suction conduit 76 leading through valve passage 52. Conduit 76 connects to the perforated bottom peripheral tube 22 to apply suction, i.e., pull a vacuum within the walls of the inflatable bag 18, and return it to its original position for receipt of another load of granular material.

When the inner wall 18 of the double-walled inflatable bag is completely returned to its original position, increased vacuum will be sensed on a vacuum sensing line 30 and control box 26 will turn off the fan motors 32 and 34 leaving the system at rest with the inflatable collar inflated, any slack in the wall of the bag 18 near its top and the bin ready to be refilled.

In addition to the vacuum sensing line 30 there is a high-pressure sensing line 31 connected from the inside of the bag wall near the top thereof to the control box 26. When there is excessive pressure within the walls of the bag, e.g., when there is material blockage, the excess pressure sensing line 31 senses this excess pressure and control box 26 shuts off the fans 36 and 38 so that they will not keep running when material is not discharging, or develop pressure which might damage the bag 18.

Turning now to FIGS. 3 and 4 showing the mechanical elements of the valve assembly 44, the valve assembly is built on a base member 78 on which are assembled four gate valves 80, 82, 84, and 86. Within these gate valves there are slidable gates 88, 90, 92, and 94 respectively. Valves 80 and 84 are connected to move together by connecting stem 96, so that when one is open the other is closed. Similarly, valves 82 and 86 are connected to move together via connecting stem 98. These connecting valve stems are in turn connected by a cross member 100.

The gate valves are held onto the base by valve holding straps 102 and 104 which are secured to the base by suitable screw connectors 106.

Upstanding brackets 108 at one end of base member 78 mount the drive motor means 45, which includes a motor and gear train assembly 110 of a suitble type, for example, that made by Van Weise Gear Co., St. Louis, Mo., and available commercially to raise and lower hospital beds. The motor and gear train assembly drives a screw 112 which in turn is threaded internally within tube 114 so that upon rotation of screw 112, the tube 114 moves linearly. The tube 114 is connected to the cross member 100 by bolt means 116 so that upon operation of the motor assembly 110, the valves may be moved from one cycle to the other as explained in connection with FIGS. 1 and 2. Limit switches 60 and 62 cooperate with the cross member 110 to limit the valve movements in each of the two separate positions.

As can be seen, this invention provides a unique, simple, and inexpensive valve assembly and control system for controlling the inflation and deflation cycles of a storage bin of the type utilizing an inflatable bag. Additionally, however, the valve assembly itself could also be utilized in other environments requiring high-volume, low-pressure flow or other flow characteristics requiring alternately opening and closing separate pairs of fluid paths. One possible use of the invention might be in connection with swimming pool cycle changes.

What is claimed is:

1. In a system for handling, storing, and discharging free-flowing granular material, the system being of the type having a dual wall cup-shaped inflatable bag for storing and discharging the material, and a fan means for inflating and deflating the bag, an improved valve and control assembly comprising;

(a) a pair of inlet conduits connected to the intake of the fan means, one of the inlet conduits also connected to the interior of the inflatable bag for deflating the bag, and the other of the inlet conduits in communication with the atmosphere, (b) two outlet conduits connected to the outlet of the fan means, one of the outlet conduits in communication with the atmosphere, and the other of the outlet conduits connected to inflate the bag, (c) a unitary valve assembly including valve means controlling high-volume, low-pressure flow from the fan means through the pair of inlet and the pair of outlet conduits by allowing flow through one of the inlet and one of the outlet conduits in one position of the valve means while blocking flow through the other of the conduits, and by allowing flow through the other of the inlet and other of the outlet conduits in another position of the valve means while blocking through the one of the inlet and one of the outlet conduits.

2. A system as in claim 1 further comprising a high pressure sensing means connected to the interior of the bag and operable to shut off the fan means on detection of excess pressure.

3. A system as defined in claim 1 further comprising means operable when the bag is fully emptied or fully deflated for controlling the operation of the valve means.

4. A system as in claim 3 wherein the means operable when the bag is fully emptied includes a limit switch means operable by lifting of the inner wall of the bag at the time the bag is fully emptied.

5. A system as in claim 3 wherein the means operable when the bag is fully deflated includes a vacuum sensing means operable to sense increased vacuum in the last stage of deflating the bag.

6. A system as in claim 1 further comprising an extension conduit on the outlet on the one of the outlet conduits which is in free communication with the atmosphere, the extension conduit leading to and connected to an inflatable pillow at the top edge of the inflatable cup-shaped bag.

7. A system as in claim 6 further comprising a one-way valve and a pressure relief valve serially arranged in the extension conduit.

8. A system as in claim 1 wherein the valve assembly includes a base member having passages therethrough at least as large as the conduits, and the valve means includes four slide operated gate valves supported by the base member, one gate valve for each conduit to be controlled, and gate valve actuator means for actuating the gate valves in tandem pairs for controlling the conduits.

9. A system as in claim 8 wherein the actuator means is a motor-driven screw with means for connecting it to the gate valves for the tandem operation.

10. A system as in claim 9 wherein the means for connecting the screw to the gate valves includes a cross member carried by the screw, the sides of the cross member being connected to stems of the gate valves for operating all four gate valves, simultaneously opening two and closing two.

11. A system as defined in claim 10 further comprising limit switches positioned to be contacted by the cross member when the valves reach the limit of their movement and being either fully opened or fully closed.

12. In a system for handling, storing, and discharging free-flowing granular material, the system being of the type having an inflatable membrane for storing and discharging the material, and a fan means for moving the membrane, an improved valve and control assembly comprising:

(a) a pair of inlet conduits connected to the intake of the fan means, one of the inlet conduits also connected to the interior of the inflatable membrane for deflating the membrane, and the other of the inlet conduits in communication with the atmosphere, (b) two outlet conduits connected to the outlet of the fan means, one of the outlet conduits in communication with the atmosphere, and the other of the outlet conduits connected to the inflation membrane to inflate the membrane, (c) a unitary valve assembly including valve means controlling high-volume, low-pressure flow from the fan means through the pair of inlet and the pair of outlet conduits by allowing flow through a first inlet conduit and a first outlet conduit in one position of the valve means while blocking flow through a second inlet conduit and second outlet conduit, and by allowing flow through the second inlet conduit and the second outlet conduit in another position of the valve means while blocking through the first inlet conduit and the first outlet conduit.

* * * * *

UNITED STATES PATENT AND TRADEMARK OFFICE

CERTIFICATE OF CORRECTION

PATENT NO. : 4,487,335

DATED : December 11, 1984

INVENTOR(S) : Timothy C. Bonerb

It is certified that error appears in the above-identified patent and that said Letters Patent is hereby corrected as shown below:

Col. 1, line 46, delete "highy" and insert therefor -- highly --.

Col. 2, line 41, delete "granual" and insert therefor -- granular --.

Signed and Sealed this

*Twenty-first* Day of *May 1985*

[SEAL]

*Attest:*

DONALD J. QUIGG

*Attesting Officer*

*Acting Commissioner of Patents and Trademarks*